US007057588B2

(12) United States Patent
Asano et al.

(10) Patent No.: US 7,057,588 B2
(45) Date of Patent: Jun. 6, 2006

(54) ACTIVE-MATRIX DISPLAY DEVICE AND METHOD OF DRIVING THE SAME

(75) Inventors: Mitsuru Asano, Kanagawa (JP); Akira Yumoto, Kanagawa (JP)

(73) Assignee: Sony Corporation (JP)

( * ) Notice: Subject to any disclaimer, the term of this patent is extended or adjusted under 35 U.S.C. 154(b) by 475 days.

(21) Appl. No.: 10/667,596

(22) Filed: Sep. 23, 2003

(65) Prior Publication Data

US 2004/0070557 A1 Apr. 15, 2004

(30) Foreign Application Priority Data

Oct. 11, 2002 (JP) ..... P2002-298428

(51) Int. Cl.
*G09G 3/36* (2006.01)

(52) U.S. Cl. ..... 345/76; 345/82

(58) Field of Classification Search ..... 345/76, 345/82, 90, 91, 92; 315/169.1, 169.3
See application file for complete search history.

(56) References Cited

U.S. PATENT DOCUMENTS 6,914,390 B1 * 7/2005 Koyama ..... 315/169.3
2004/0100427 A1 * 5/2004 Miyazawa ..... 345/76

* cited by examiner

*Primary Examiner*—Dennis-Doon Chow
(74) *Attorney, Agent, or Firm*—Rader, Fishman & Grauer PLLC; Ronald P. Kananen

(57) ABSTRACT

In an active-matrix display device and a method for driving the active-matrix display device, a fifth transistor is connected between a power line and a drain terminal of a first transistor so that a power-supply voltage, namely the fixed voltage required for the compensation of the threshold voltage, is supplied by the power line via a fifth transistor and not by a signal line. Thus, a sufficient length of time for the threshold voltage compensation period can be maintained, and a second transistor of each pixel can accurately be compensated for threshold voltage irregularities.

12 Claims, 14 Drawing Sheets

ACTIVE-MATRIX DISPLAY DEVICE AND METHOD OF DRIVING THE SAME

BACKGROUND OF THE INVENTION

1. Field of the Invention

The present invention relates to active-matrix display devices which include pixels (pixel circuits) having display elements arranged in a matrix and which write and display image data with scanning lines and signal lines and to methods of driving such active-matrix display devices. In particular, the present invention relates to an active-matrix display device having, for example, an organic electroluminescent (referred to as EL hereinafter) element as a display element, and to a method of driving the active-matrix organic-EL display device.

2. Description of the Related Art

In active-matrix display devices, an electro-optical element, such as a liquid crystal cell or an organic-EL element, is used for the display element of each pixel. The organic-EL element has a structure in which an organic layer is disposed between electrodes. By applying a voltage to the organic-EL element, electrons are injected into the organic layer from the cathode and holes are injected into the organic layer from the anode. The electrons and the holes then recombine to emit light. Organic-EL elements have the following characteristics:

1. Organic-EL elements require low-power consumption, less than or equal to 10 V, for driving to achieve a luminance of 100 to 10,000 cd/m$^2$.

2. Organic-EL elements have a high image contrast due to being self-luminous, have good visibility due to their high response speed, and are also suitable for moving image displays; and 3. Organic-EL elements are all-solid-state elements having a simple structure, thus achieving high reliability and low-profile elements.

Organic-EL display devices (referred to as organic-EL displays hereinafter) having organic-EL elements with such characteristics for the display elements of the pixels are expected to be used as next-generation flat panel displays.

As methods for driving organic-EL displays, a simple-matrix method and an active-matrix method are known. Of these two methods, the active-matrix method has the following characteristics:

1. The active-matrix method is capable of maintaining the light emission of the organic-EL element of each pixel within a period of one frame and is thus suitable for high-definition and high-luminance organic-EL displays; and 2. The active-matrix method is capable of having a peripheral circuit with thin film transistors formed on a panel so as to simplify the external interface of the panel and also to achieve a highly-functional panel.

In active-matrix organic-EL displays, polysilicon thin film transistors (referred to as TFTs hereinafter) having polysilicon as the active layer are commonly used for the transistors, that is, active elements. The reasons for this common use of polysilicon TFTs are their superior driving ability and their capability of reducing the pixel size to achieve high definition. On the other hand, however, polysilicon TFTs are also known for having highly irregular characteristics.

Accordingly, for an active-matrix organic-EL display using the polysilicon TFTs, irregularities in the characteristics of the TFTs need to be reduced and the irregularities of the TFTs in the circuits need to be compensated. This is due to the following reason. In a liquid crystal display having liquid crystal cells as the display elements of the pixels, the luminance data of the pixels is controlled by a voltage, whereas in an organic-EL display, the luminance data of the pixels is controlled by an electrical current.

A general outline of the active-matrix organic-EL display will now be described. Referring to FIG. 11, a schematic view of the active-matrix organic-EL display is illustrated. Referring to FIG. 12, a diagram of one of the pixel circuits of the active-matrix organic-EL display is illustrated (for an example, see Japanese Unexamined Patent Application Publication No. 8-234683). In the active-matrix organic-EL display, m columns×n rows of pixels 101 are arrayed in a matrix. In the matrix-arrayed pixels 101, each of m columns of signal lines 103-1 to **103-*m*, which are driven by a data driver 102, is connected with the pixels 101 in a corresponding pixel column, and each of n rows of scanning lines 105-1 to 105-*n*, which are driven by a scan driver 104, is connected with the pixels 101** in a corresponding pixel row.

As is apparent from FIG. 12, each of the pixels (pixel circuits) 101 includes an organic-EL element 110, a first transistor 111, a second transistor 112, and a capacitor 113. A N-channel transistor is used for the first transistor 111, and a P-channel transistor is used for the second transistor 112.

A source terminal of the first transistor 111 is connected with a corresponding one of the signal lines 103 (103-1 to **103-*m*), and a gate terminal is connected with a corresponding one of the scanning lines 105 (105-1 to 105-*n*). A first end of the capacitor 113 is connected with a first power line 121 of a power-supply voltage VCC1, which may be, for example, a positive supply voltage. A second end of the capacitor 113 is connected with a drain terminal of the first transistor 111. A source terminal of the second transistor 112 is connected with the first power line 121, and a gate terminal of the second transistor 112 is connected with the drain terminal of the first transistor 111. An anode of the organic-EL element 110 is connected with a drain terminal of the second transistor 112, and a cathode of the organic-EL element 110 is connected with a second power line 122 of a power-supply voltage VCC2**, which may be, for example, a ground potential.

In the pixel circuit described above, a row which includes one of the pixels that writes the luminance data is selected by the scan driver 104 via the scanning line 105. This turns ON the first transistors 111 of the pixels in the row. The luminance data is supplied through a voltage from the data driver 102 via the signal line 103. The luminance data is then transmitted through the first transistor 111 and is written into the capacitor 113, which holds the data voltage. The luminance data written in the capacitor 113 is held for a period of one field. The held data voltage is applied to the gate terminal of the second transistor 112.

The second transistor 112 drives the organic-EL element 110 with electrical current according to the held data. A grayscale is achieved in the organic-EL element 110 by modulating the voltage Vdata (<0) held by the capacitor 113 between the gate and the source of the second transistor 112.

The luminance $L_{oled}$ of the organic-EL element is usually proportional to the electrical current $I_{oled}$ in the element. Consequently, the following equation holds between the luminance $L_{oled}$ and the electrical current $I_{oled}$ of the organic-EL element:

$$L_{oled} \propto I_{oled} = k(Vdata - Vth)^2 \quad (1)$$

In Equation (1), $k=1/2\cdot\mu\cdot Cox\cdot W/L$, where μ indicates the carrier mobility of the second transistor, Cox indicates the gate capacitance per unit area of the second transistor 112, W indicates the gate width of the second transistor 112, and L indicates the gate length of the second transistor 112. Accordingly, the mobility μ of the second transistor 112 and irregularities in the threshold voltage Vth (<0) directly affect the luminance irregularities of the organic-EL element.

To compensate for the threshold voltage Vth, which tends to cause luminance irregularities easily, a threshold voltage compensation pixel circuit is presented in, for example, U.S. Pat. No. 6,229,506.

FIG. 13 is a circuit diagram of a conventional threshold voltage compensation pixel circuit. In FIG. 13, similar parts as in FIG. 12 are indicated with the same reference numerals. As is apparent from FIG. 13, this conventional pixel circuit includes an organic-EL element 110, four transistors 111, 112, 114, and 115, and two capacitors 113 and 116. In an organic-EL display having this pixel circuit, three scanning lines 105A, 105B, and 105C, which are driven by a scan driver 104 (see FIG. 11), are interconnected with corresponding rows of pixels.

A source terminal of the first transistor 111 is connected with a signal line 103, and a gate terminal of the first transistor 111 is connected with a first scanning line 105A. A first end of the first capacitor 116 is connected with the drain terminal of the first transistor 111. A gate terminal of the second transistor 112 is connected with a second end of the first capacitor 116, and a source terminal of the second transistor 112 is connected with a first power line 121 of a power-supply voltage VCC1, which may be, for example, a positive supply voltage. A first end of the second capacitor 113 is connected with the first power line 121, and a second end of the second capacitor 113 is connected with the gate terminal of the second transistor 112.

A gate terminal of a third transistor 114 is connected with a second scanning line 105B, a source terminal of the third transistor 114 is connected with the gate terminal of the second transistor 112, and a drain terminal of the third transistor 114 is connected with the drain terminal of the second transistor 112. A gate terminal of a fourth transistor 115 is connected with a third scanning line 105C, and a source terminal of the fourth transistor 115 is connected with the drain terminal of the second transistor 112. An anode of the organic-EL element 110 is connected with a drain terminal of the fourth transistor 115, and the cathode is connected with the second power line 122 of a power-supply voltage VCC2, which may be, for example, a ground potential.

The operation of the conventional threshold voltage compensation pixel circuit will now be described with reference to the timing diagram of FIG. 14. This timing diagram describes the timing relationship of an i-th row and an (i+1)-th row in the pixel circuit during driving. Furthermore, the term "compensate" refers to the threshold voltage compensation period, the term "write" refers to the data writing period, and the term "hold" refers to the data holding period.

In the operation of this pixel circuit, the threshold voltage compensation period comes before the data writing period. In this threshold voltage compensation period, a scanning pulse SCAN1 is supplied via the first scanning line 105A at a high level (referred to as an "H" level hereinafter) to turn the first transistor 111 ON. A fixed voltage $V_o$ is then supplied to the signal line 103 from the data driver 102. Thus, the fixed voltage $V_o$ is written into the first capacitor 116 via the first transistor 111. A scanning pulse SCAN2 supplied via the second scanning line 105B also reaches the "H" level at this time to turn ON the third transistor 114. Also, since a scanning pulse SCAN3 supplied via the third scanning line 105C is at a low level (referred to as an "L" level hereinafter), the fourth transistor 115 is OFF.

In this state, the first capacitor 116 having the fixed voltage $V_o$ adjacent to the first end of the capacitor 116 is charged from the second end via the source and drain terminals of the third transistor 114. If the threshold voltage compensation period is long enough, the voltage adjacent to the second end of the first capacitor 116, that is, the voltage between the gate and the source terminals of the second transistor 112, converges toward the threshold voltage Vth (<0) of the transistors.

In the subsequent data writing period, since the scanning pulse SCAN1 is maintained at the "H" level, the first transistor 111 is kept in an ON mode, and data voltage $V_o$+Vdata (Vdata<0) is supplied from the signal line 102. Because the scanning pulse SCAN2 is at the "L" level at this time, the third transistor 114 is OFF.

By neglecting, for example, the gate capacitance or the parasitic capacitance of the transistors, the voltage between the gate and source terminals of the second transistor 112 can be represented by the following equation:

$$Vgs=Vth+C1/(C1+C2)\cdot Vdata \quad (2)$$

where C1 and C2 indicate the capacitance of the first and second capacitors 116 and 113, respectively.

By applying equation (2), the electrical current $I_{oled}$ flowing through the organic-EL element 110 can be represented by the following equation:

$$I_{oled}\propto I_{oled}=k\{C1/(C1+C_2)\cdot Vdata\}^2 \quad (3)$$

As is apparent from equation (3), the electrical current $I_{oled}$ flowing through the organic-EL element 110 is not affected by the threshold voltage Vth of the second transistor 112. In other words, by using the conventional threshold voltage compensation pixel circuit, the threshold voltage Vth of the transistor 112 of each pixel is compensated. This means that irregularities in the threshold voltage Vth of the second transistor 112 do not cause the luminance irregularities of the organic-EL element 110.

In the conventional threshold voltage compensation pixel circuit described above, during the threshold voltage compensation period, the second transistor 112 is gradually turned OFF as the voltage between the source terminal and the gate terminal approaches the threshold voltage Vth. This also deactivates its operation and requires too much time for the voltage between the source terminal and the gate terminal of the transistor 112 to converge toward the threshold voltage Vth. For this reason, the threshold voltage compensation period requires a large amount of time.

The differential equation of the gate voltage of the second transistor 112 in the threshold voltage compensation period is as follows:

$$k\cdot\{Vgs(t)-Vth\}^2=-Cs\cdot dVgs/dt \quad (4)$$

In equation (4), a sufficient length of the threshold voltage compensation period is considered to be the time required for the amount of electrical current to be half of the amount during the minimum luminance.

If the electrical current value during the maximum luminance of the organic-EL element 110 is represented by $I_{max}$, the initial value of the voltage Vgs between the gate terminal and the source terminal of the second transistor 112 is indicated by $V_{init}$, the hold capacitor of the gate voltage of the second transistor 112, which is mainly the capacitance C1 of the second capacitor 113, is indicated by Cs, the grayscale value is indicated by n, and the voltage Vgs between the gate terminal and the source terminal that provides the electrical current $I_{max}$ during the maximum luminance is represented by Vgs=ΔV+Vth, then the following equation describes the time required for the amount of electrical current to be half of the amount during the minimum luminance, which is indicated by $I_{max}/2$ (n−1)

$$t=Cs\cdot\Delta V/I_{max}\{\sqrt{(2n-2)}-\Delta V/V_{init}\} \quad (5)$$

For example, if Cs=1 [pF], n=64, ΔV=4, and $I_{max}$=1 [μA] and if the second term is sufficiently small, then t=45 [μs]. On the other hand, if the resolution (graphics display standard) is VGA, the number of the scanning lines is 480, and the frame frequency is 60 Hz, then one horizontal period is about 30 μs. This means that it is difficult to complete the threshold voltage compensation period in one horizontal period.

Accordingly, in a VGA-class display, a sufficient length of the threshold voltage compensation period requires several μs to several tens of μs. For this reason, it is difficult to perform the threshold voltage compensation and the data writing continuously within one horizontal period. In other words, the conventional threshold voltage compensation pixel circuit cannot be applied to a VGA-class organic-EL display. Furthermore, as the display becomes more highly defined, one horizontal period, which is inversely proportional to the number of scanning lines, becomes shorter. Thus, a sufficient length of the threshold voltage compensation period is even more difficult to maintain.

In the conventional threshold voltage compensation pixel circuit, a signal-line voltage corresponding to the threshold voltage compensation period and the data writing period, that is, the fixed voltage $V_o$ during the threshold voltage compensation period and the data voltage Vdata+fixed voltage $V_o$ during the data writing period, must be supplied from the signal line 103. For this reason, the structure of the data driver 102 (see FIG. 11), which is the signal line driving circuit, tends to be complex.

SUMMARY OF THE INVENTION

An object of the present invention is to provide a high-definition active-matrix display device using threshold voltage compensation pixel circuits to improve the uniformity of a display image and to ensure a sufficient length of a threshold voltage compensation period regardless of the length of one horizontal period.

An active-matrix display device of the present invention includes pixel circuits arrayed in a matrix; signal lines each of which is interconnected with a corresponding column of the matrix-arrayed pixel circuits; and a first scanning line, a second scanning line, a third scanning line, and a fourth scanning line that are interconnected with a corresponding row of the matrix-arrayed pixel circuits. Each of the pixel circuits includes a first transistor of which a gate terminal is connected with the first scanning line and of which a first electrode terminal is connected with one of the signal lines; a first capacitor of which a first end is connected with a second electrode terminal of the first transistor; a second capacitor of which a first terminal is connected with the first end or a second end of the first capacitor; a second transistor of which a gate terminal is connected with the second end of the first capacitor and of which a first electrode terminal is connected with a first power line; a third transistor of which a gate terminal is connected with the second scanning line, a first electrode terminal of the third transistor is connected with the gate terminal of the second transistor, and a second electrode terminal of the third transistor is connected with a second electrode terminal of the second transistor; a fourth transistor of which a gate terminal is connected with the third scanning line and of which a first electrode terminal is connected with the second electrode terminal of the second transistor; a fifth transistor of which a gate terminal is connected with the fourth scanning line, a first electrode terminal of the fifth transistor is connected with a third power line, and a second electrode terminal of the fifth transistor is connected with the second electrode terminal of the first transistor; and a display element connected with both a second electrode terminal of the fourth transistor and a second power line.

In the active-matrix display device, the first transistor and the fourth transistor are turned OFF and the third transistor and the fifth transistor are turned ON, so that the threshold voltage of the second transistor in each pixel is compensated. The first transistor is then turned ON and the third transistor and the fifth transistor are turned OFF, so as to drive the device to write the display data to the pixel from the signal line. During the period of compensating the threshold voltage of the second transistor, the fifth transistor supplies a power-supply voltage of the third power line as a fixed voltage to the first capacitor.

Accordingly, by supplying the fixed voltage required for the threshold voltage compensation from a power line and not from a signal line, the compensation of the threshold voltage is performed in one pixel while concurrently writing the display data from the signal line in another pixel. For any one row of pixels, one horizontal period can be set as the data writing period and any length of period can be set as a threshold voltage compensation period prior to the data writing period. Thus, a sufficient amount of time for the threshold voltage compensation period can be maintained. This accurately compensates for irregularities of the threshold voltage of transistors in each pixel so as to improve the uniformity of the luminance and also to achieve a high definition of the display.

The present invention needs to supply only the data voltage continuously, which simplifies the structure of the signal line driving circuit. Furthermore, since the power-supply voltage of the signal line driving circuit can be reduced to an extent that the fixed voltage is eliminated, a low power consumption for the entire display can be achieved.

DESCRIPTION OF THE PREFERRED EMBODIMENTS

Figure 1:
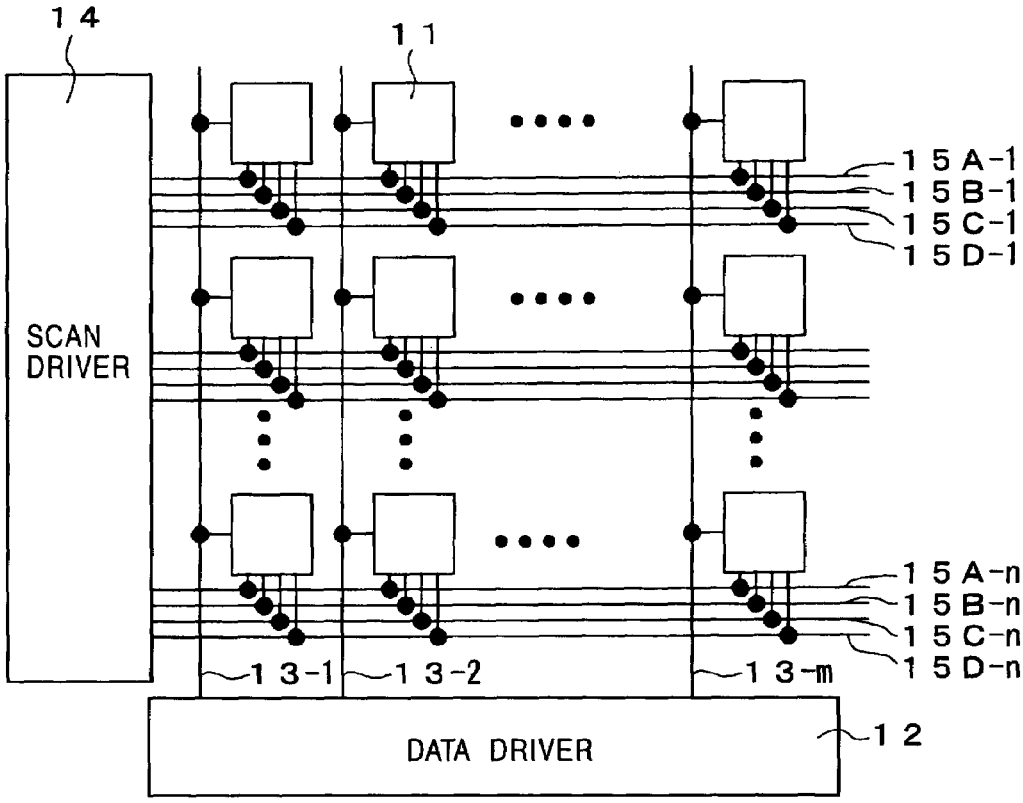
FIG. 1 is a schematic block diagram of an active-matrix display device according to an embodiment of the present invention.

Embodiments of the present invention will now be described with reference to the drawings. FIG. 1 is a schematic block diagram of an active-matrix display device according to an embodiment of the present invention. In this embodiment, an organic-EL element is used as a display element of each pixel, and a polysilicon thin film transistor (TFT) is used as an active element. The present invention will be described using as an example an active-matrix organic-EL display having organic-EL elements formed on a substrate with the TFTs thereon.

Referring to FIG. 1, m columns×n rows of pixels (pixel circuits) 11 are arrayed in a matrix. Each of the pixels 11 has an organic-EL element as the display element. In the matrix array of the pixels 11, each column of the pixels is interconnected with a corresponding column of signal lines (data lines) 13-1 to **13-*m*. The signal lines are driven by a data driver 12 which is a signal-line driving circuit. Each of the n rows includes multiple scanning lines, which may be, for example, four lines that are driven by a scan driver 14, that is, a scanning-line driving circuit. Each group of the multiple scanning lines 15A-1 to 15D-1, 15A-2 to 15D-2, . . . 15A-n to 15**D-n is interconnected with a corresponding row of pixels.

The distinctive feature of the active-matrix organic-EL display of the present invention is in the structure and the operation of the pixels (pixel circuits) 11. Examples of specific circuits of the pixels 11 will now be described.

[Circuit 1]

Figure 2:
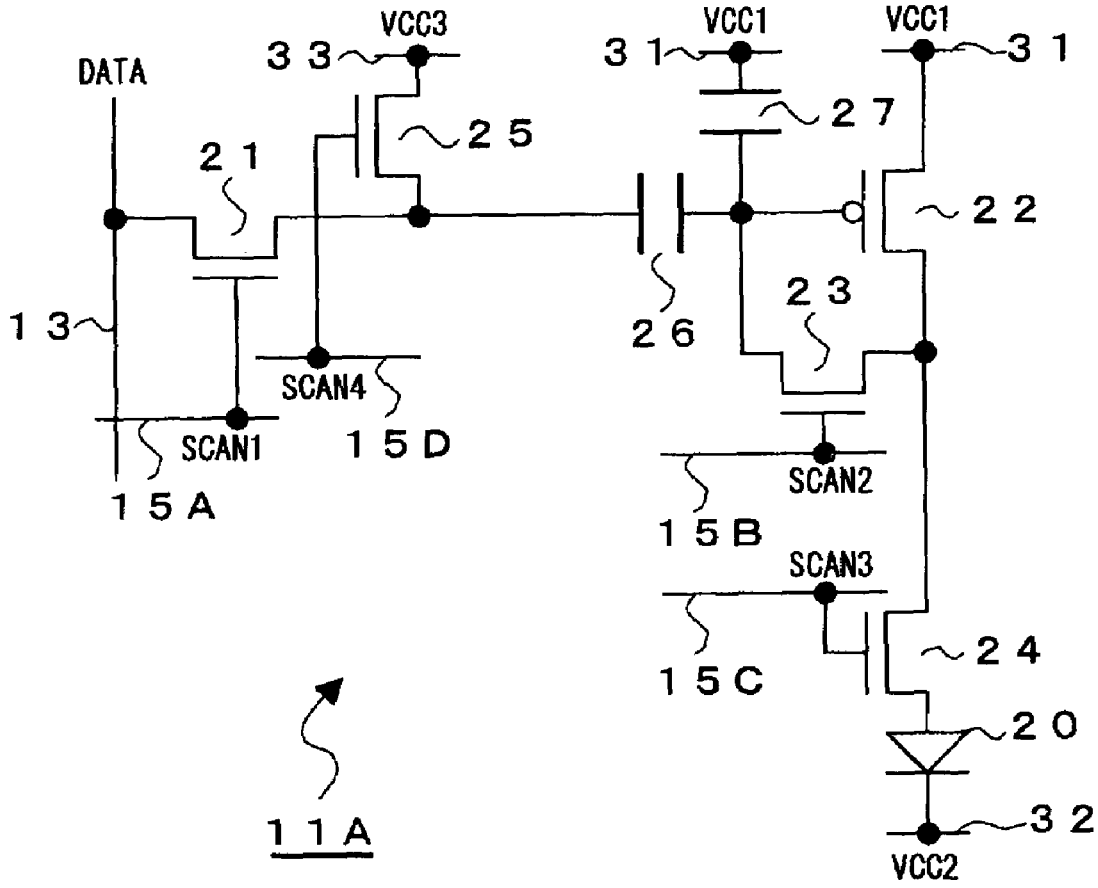
FIG. 2 is a circuit diagram of a pixel circuit of Circuit 1.

FIG. 2 is a circuit diagram of a pixel circuit 11A according to Circuit 1. As is apparent from FIG. 2, the pixel circuit 11A includes an organic-EL element 20, five transistors 21 to 25, and two capacitors 26 and 27. The organic-EL element 20 is formed of an organic layer including a luminous layer disposed between first and second electrodes.

The first to fifth transistors 21 to 25 are polysilicon thin film transistors (TFT) having polysilicon as an active layer. In Circuit 1, a P-channel transistor is used for the second transistor 22. For other transistors 21, 23, 24, and 25, N-channel transistors are used.

A source terminal of the first transistor 21 is connected with a signal line 13, and a gate terminal of the transistor 21 is connected with a first scanning line 15A. An input end of a first capacitor 26 is connected with a drain terminal of the first transistor 11. The gate terminal of the second transistor 22 is connected with an output end of the first capacitor 26, and a source terminal of the transistor 22 is connected with a first power line 31 of a power-supply voltage VCC1, which may be, for example, a positive supply voltage.

A first end of the second capacitor 27 is connected with the first power line 31, and a second end is connected with the gate terminal of the second transistor 22. A gate terminal of the third transistor 23 is connected with a second scanning line 15B, a source terminal is connected with the gate terminal of the second transistor 22, and the drain terminal is connected with the drain terminal of the second transistor 22. A gate terminal of the fourth transistor 24 is connected with a third scanning line 15C, and a source terminal is connected with the drain terminal of the second transistor 22.

A gate terminal of the fifth transistor 25 is connected with a fourth scanning line 15D, a source terminal is connected with a third power line 33 of a power-supply voltage VCC3, which may be, for example, a positive supply voltage, and a drain terminal is connected with the drain terminal of the first transistor 21, which is the input end of the first capacitor 26. The power-supply voltage VCC3 has a voltage value that is different from that of the power-supply voltage VCC1. An anode of the organic-EL element 20 is connected with a drain terminal of the fourth transistor 24, and a cathode is connected with a second power line 32 of a power-supply voltage VCC2, which may be, for example, a ground potential.

Figure 3:
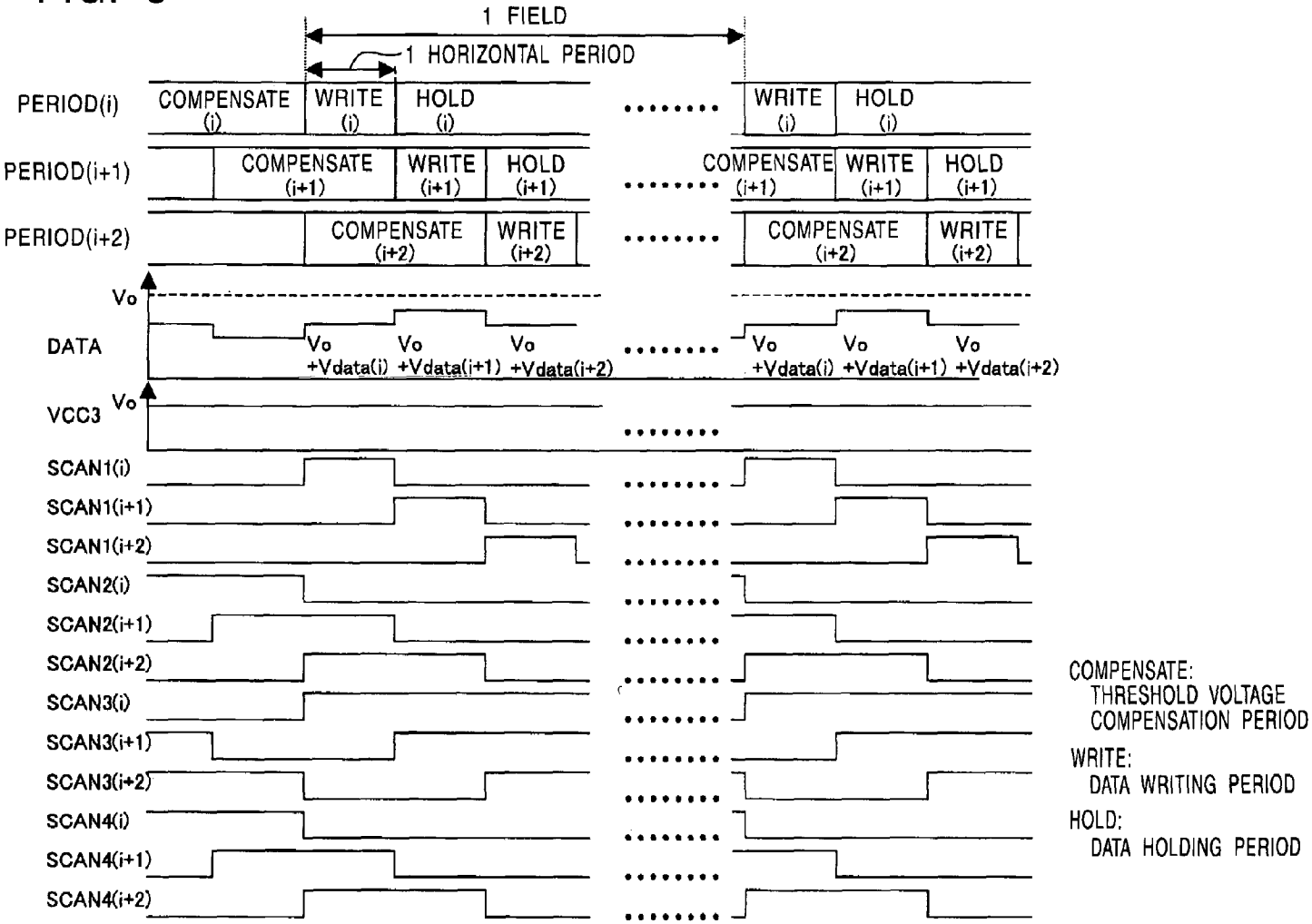
FIG. 3 is a timing diagram for describing the operation of the pixel circuit of Circuit 1.

The pixel circuit 11A of Circuit 1 is distinctive in that the data writing period and the threshold voltage compensation period are present simultaneously between the pixels connected along the same signal line. The operations of the data writing period and the threshold voltage compensation period will be described with reference to the timing diagram of FIG. 3, using an i-th row of pixels as an example. In FIG. 3, the term "compensate" indicates the threshold voltage compensation period, the term "write" indicates the data writing period, and the term "hold" indicates the data holding period.

In the threshold voltage compensation period, a scanning pulse SCAN1(*i*) supplied by the scan driver 14 (see FIG. 1) via the first scanning line 15A is at a "L" level so that the first transistor 21 is OFF. A scanning pulse SCAN4(*i*) supplied via the fourth scanning line 15D is at an "H" level so that the fifth transistor 25 is ON. Thus, the power-supply voltage VCC3, namely, a fixed voltage $V_o$, is supplied from the third power line 33 through the fifth transistor 25 and to the input end of the first capacitor 26.

At the same time, because a scanning pulse SCAN2(*i*) supplied via the second scanning line 15B is at an "H" level, the third transistor 23 is in an ON mode. Also, because a scanning pulse SCAN3(*i*) supplied via the third scanning line 15C is at a "L" level, the fourth transistor 24 is OFF. Thus, the first capacitor 26 is charged from its output end via the source and drain terminals of the third transistor 23. If the threshold voltage compensation period is sufficiently long, the voltage between the gate and source terminals of the second transistor 22 converges toward the threshold voltage Vth (<0) of the transistor.

At the beginning of the data writing period, the scanning pulse SCAN1(*i*) is at an "H" level and the first transistor 21 is in an ON mode. Also, the scanning pulse SCAN4(*i*) is at a "L" level and the fifth transistor 25 is in an OFF mode. Thus, a data voltage $V_o$+Vdata (Vdata<0) is supplied from the signal line 13 via the first transistor 21. In this case, because the scanning pulse 2(*i*) is at a "L" level, the third transistor 23 is in an OFF mode.

The equations (2) and (3) mentioned previously hold also in this pixel circuit 11A of Circuit 1. Thus, the electrical current $I_{oled}$ flowing through the organic-EL element 20 is not affected by the threshold voltage Vth of the transistor. In other words, the threshold voltage Vth of the second transistor 22 in each pixel is compensated.

Similarly, the time required for the threshold voltage compensation period can be represented by equations (4) and (5). In the pixel circuit 11A of Circuit 1, however, the connection between the input end of the first capacitor 26 and the signal line 13 during the threshold voltage compensation period is controlled by the first transistor 21, and the connection between the input end of the first capacitor 26 and the power line 33 is controlled by the fifth transistor 25. Accordingly, during the threshold voltage compensation period, the input end of the capacitor 26 is connected with the power line 33 to receive the power-supply voltage VCC3, namely, the fixed voltage $V_o$. On the other hand, during the data writing period, the input end of the capacitor 26 is connected with the signal line 13 to receive the data voltage $V_o$+Vdata.

By controlling the switching of the input end of the capacitor 26 between the threshold voltage compensation period and the data writing period, one pixel is in the data writing period to write data from the signal line 13, while at the same time, another pixel is connected with the power line 33 to be in the threshold voltage compensation period. Furthermore, a plurality of the pixels can easily be in the threshold voltage compensation period. As a result, a sufficient amount of time for the threshold voltage compensation period can be maintained.

Specifically, in a row of pixels in the pixel circuit 11A of Circuit 1, as is apparent from the timing diagram of FIG. 3, one horizontal period is equivalent to the data writing period and two horizontal periods prior to the data writing period are set as the threshold voltage compensation period. Considering the timing, it is also apparent from the diagram that while one pixel in an i-th row is in the data writing period, the other two pixels in the (i+1)-th row and the (i+2)-th row are in the threshold voltage compensation periods.

Accordingly, the threshold voltage compensation period and the data writing period are not required to be within one horizontal period. This achieves a display with high definition and also maintains a sufficient amount of time for the threshold voltage compensation period so as to allow a uniform display image. Furthermore, as is apparent from the timing diagram of FIG. 3, since the signal line 13 is only required to supply the luminance data continuously, the driving waveform of the signal line 13 is simple. The driving of the signal line 13 may be performed with a waveform similar to that of, for example, a regular liquid crystal display. Thus, the structure of the data driver 12 (see FIG. 1), that is, the signal line driving circuit, is simplified.

[Circuit 2]

Figure 4:
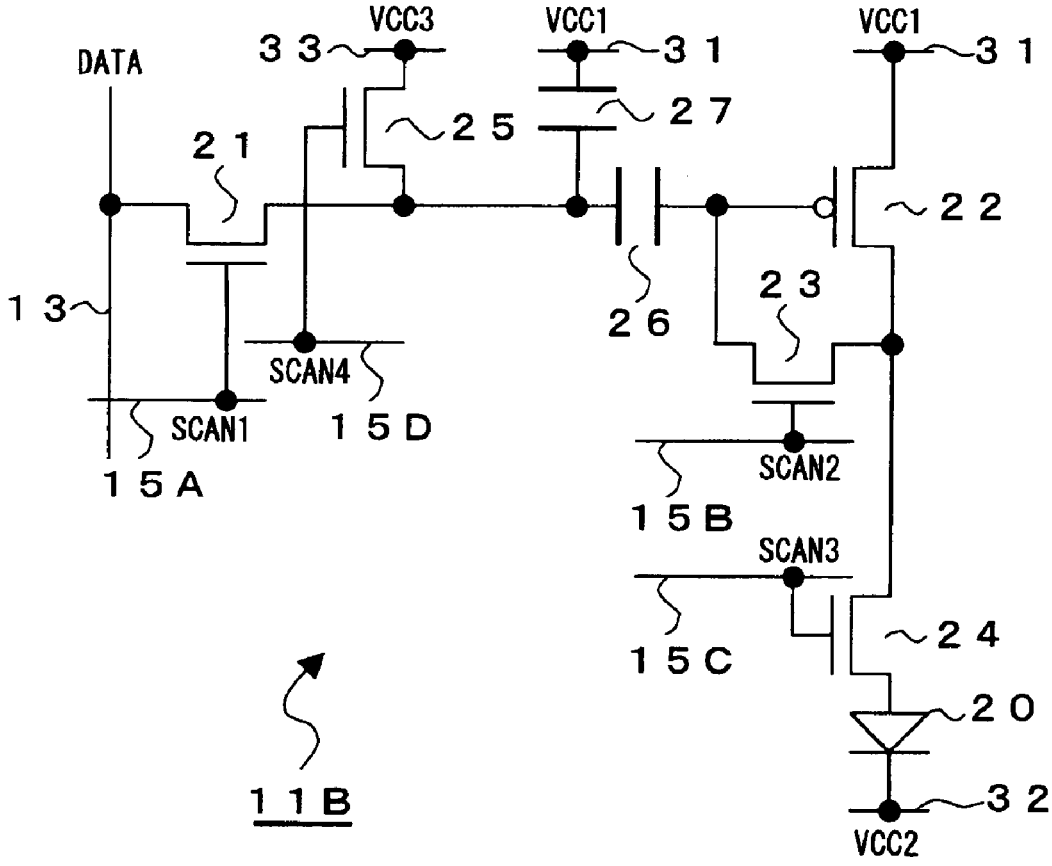
FIG. 4 is a circuit diagram of a pixel circuit of Circuit 2.

FIG. 4 is a circuit diagram of the pixel circuit 11B according to Circuit 2. In FIG. 4, similar components as in FIG. 2 are indicated with the same reference numerals. As is apparent from FIG. 4, the pixel circuit 11B is similar to the pixel circuit 11A, in that the circuit 11B includes the organic-EL element 20, the five transistors 21 to 25, and the two capacitors 26 and 27. The only structural difference between the two circuits 11A and 11B is the connecting position of the second capacitor 27 in the circuit 11B.

The connections of each circuit element will now be described in detail. The source terminal of the first transistor 21 is connected with the signal line 13, and the gate terminal of the transistor 21 is connected with the first scanning line 15A. An input end of the first capacitor 26 is connected with the drain terminal of the first transistor 11. The gate terminal of the second transistor 22 is connected with the output end of the first capacitor 26, and the source terminal of the transistor 22 is connected with the first power line 31 of the power-supply voltage VCC1, which may be, for example, a positive supply voltage.

The first end of the second capacitor 27 is connected with the first power line 31, and the second end is connected with the drain terminal of the first transistor 21, which is the output end of the first capacitor 26. The gate terminal of the third transistor 23 is connected with the second scanning line 15B, the source terminal is connected with the gate terminal of the second transistor 22, and the drain terminal is connected with the drain terminal of the second transistor 22. The gate terminal of the fourth transistor 24 is connected with the third scanning line 15C, and the source terminal is connected with the drain terminal of the second transistor 22.

The gate terminal of the fifth transistor 25 is connected with the fourth scanning line 15D, the source terminal is connected with the third power line 33 of the power-supply voltage VCC3, which may be, for example, a positive supply voltage, and the drain terminal is connected with the drain terminal of the first transistor 21, which is the input end of the first capacitor 26. The anode of the organic-EL element 20 is connected with the drain terminal of the fourth transistor 24, and the cathode is connected with the second power line 32 of the power-supply voltage VCC2, which may be, for example, a ground potential.

The operations of the threshold voltage compensation, the data writing, and the data holding in the pixel circuit 11B are basically the same as in the pixel circuit 11A. Although equations (2) and (3) hold for the pixel circuit 11A, the following equations (6) and (7) hold for the pixel circuit 11B:

$$Vgs=Vth+Vdata \tag{6}$$

$$L_{oled} \propto I_{oled}=k\{Vdata\}^2 \tag{7}$$

As is apparent from equations (6) and (7), the electrical current $I_{oled}$ flowing through the organic-EL element 20 is not affected by the threshold voltage Vth of the transistor. In other words, the threshold voltage Vth of the second transistor 22 in each pixel is compensated. Furthermore, an input voltage amplitude Vdata of the data becomes the gate voltage amplitude of the second transistor 22, thereby allowing the amplitude of the signal line 13 to become small and also achieving low power consumption.

A threshold voltage compensation pixel circuit requires a plurality of scanning lines. In the pixel circuit 11A of Circuit 1 and in the pixel circuit 11B of Circuit 2, four scanning lines 15A, 15B, 15C, and 15D are used. However, the second scanning line 15B and the fourth scanning line 15D must drive the third transistor 23 and the fifth transistor 25, respectively, into an ON mode only during the threshold voltage compensation period. Furthermore, the third scanning line 15C must drive the fourth transistor 24 into an OFF mode only during the threshold voltage compensation period. Accordingly, two or all three of the second, third, and fourth scanning lines 15B, 15C, and 15D may be combined together.

Driving of the third, fourth, and fifth transistors 23, 24, and 25 is controlled by the respective second, third, and fourth scanning lines 15B, 15C, and 15D. When combining the third scanning line 15C with at least one of the two scanning lines 15B and 15D, the conductivity type of the fourth transistor 24 must be opposite to those of the third and fifth transistors 23 and 25.

More examples of pixel circuits will now be described. To describe the pixel circuit of each of the examples below, the basic structure of the pixel circuit 11B of Circuit 2, having the second capacitor 27 connected adjacent to the input end of the first capacitor 26, will be used. Alternatively, the pixel circuit 11A of Circuit 1 also may be similarly used as the basic structure.

[Circuit 3]

Figure 5:
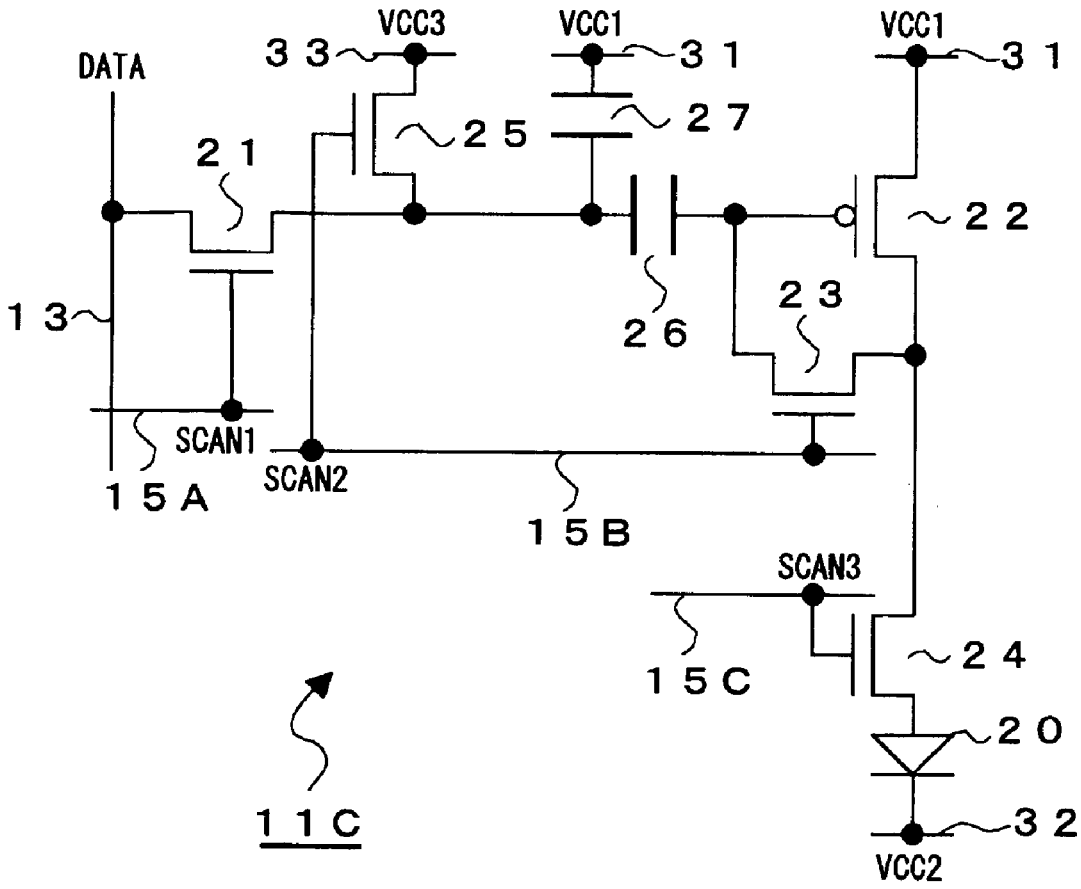
FIG. 5 is a circuit diagram of a pixel circuit of Circuit 3.

FIG. 5 is a circuit diagram of a pixel circuit 11C according to Circuit 3. In FIG. 5, similar components as in FIG. 4 are indicated with the same reference numerals. In the pixel circuit 11C, the second scanning line 15B and the fourth scanning line 15D are combined together so as to drive the third transistor 23 and the fifth transistor 25 by a common scanning pulse SCAN2.

[Circuit 4]

Figure 6:
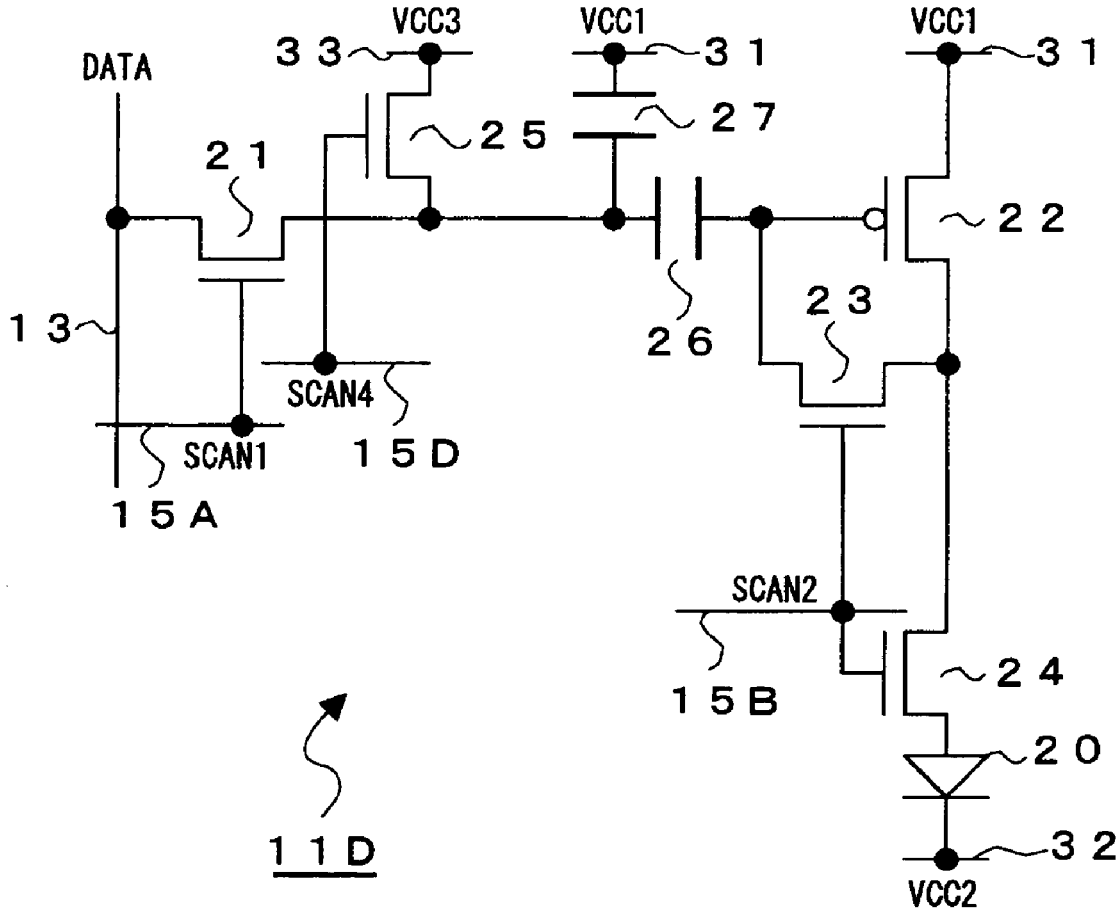
FIG. 6 is a circuit diagram of a pixel circuit of Circuit 4.

FIG. 6 is a circuit diagram of a pixel circuit 11D according to Circuit 4. In FIG. 6, similar components as in FIG. 4 are indicated with the same reference numerals. In the pixel circuit 11D, the second scanning line 15B and the third scanning line 15C are combined together so as to drive the third transistor 23 and the fourth transistor 24 by a common scanning pulse SCAN2. In this case, the third transistor 23 and the fourth transistor 24 have opposite conductivity types. In Circuit 4, a N-channel transistor is used for the third transistor 23, and a P-channel transistor is used for the fourth transistor 24.

[Circuit 5]

Figure 7:
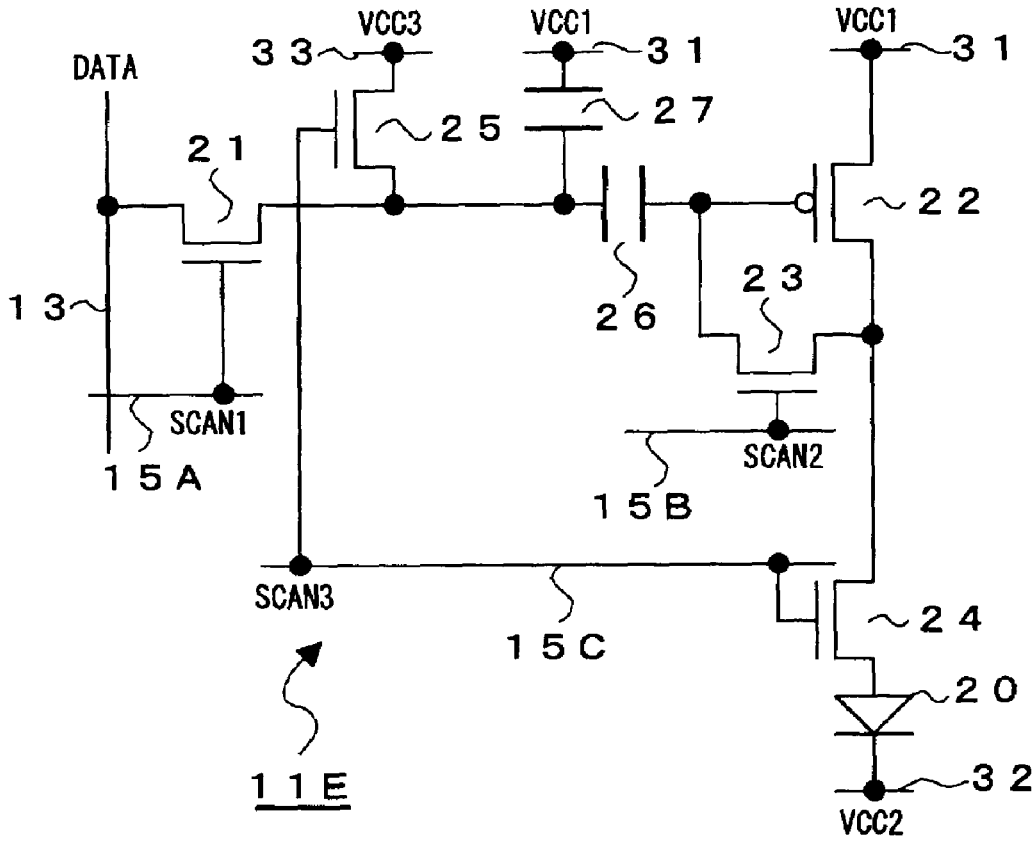
FIG. 7 is a circuit diagram of a pixel circuit of Circuit 5.

FIG. 7 is a circuit diagram of a pixel circuit 11E according to Circuit 5. In FIG. 7, similar components as in FIG. 4 are indicated with the same reference numerals. In the pixel circuit 11E, the third scanning line 15C and the fourth scanning line 15D are combined together so as to drive the fourth transistor 24 and the fifth transistor 25 by a common scanning pulse SCAN4. In this case, the fourth transistor 24 and the fifth transistor 25 have opposite conductivity types. In Circuit 5, a P-channel transistor is used for the fourth transistor 24, and a N-channel is used for the fifth transistor 25.

[Circuit 6]

Figure 8:
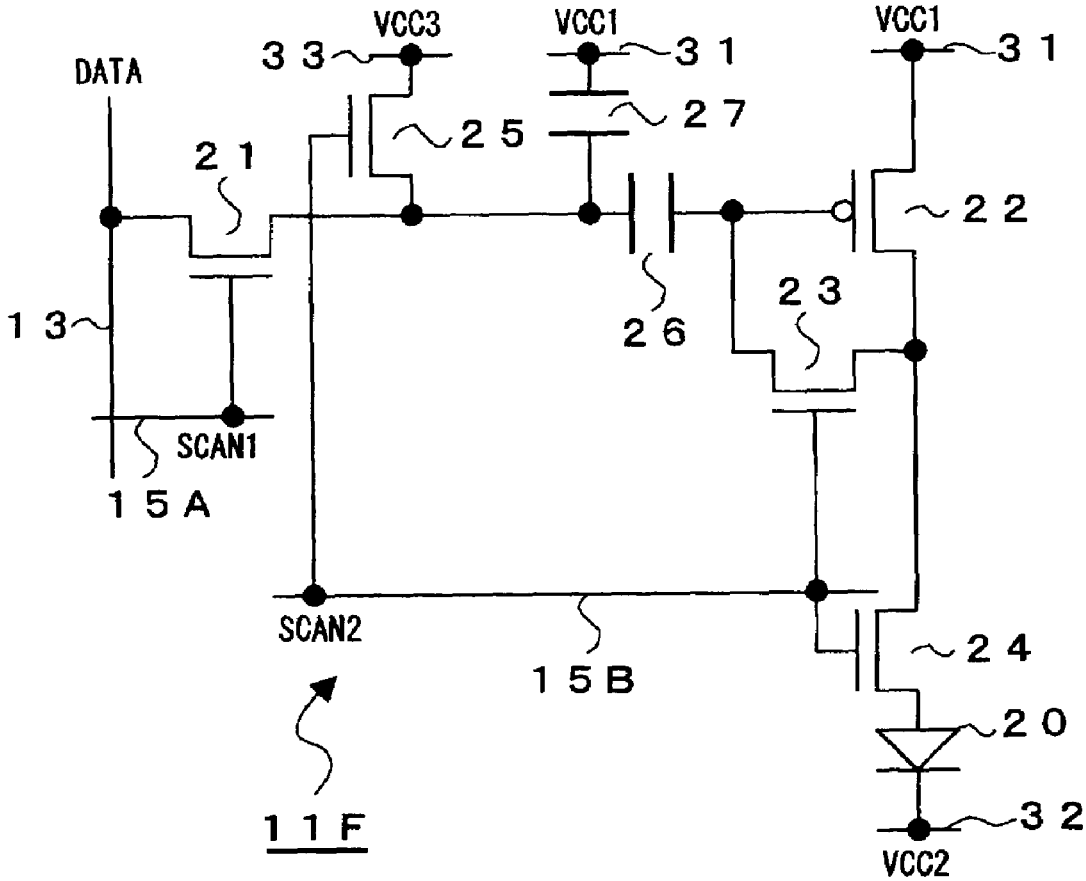
FIG. 8 is a circuit diagram of a pixel circuit of Circuit 6.

FIG. 8 is a circuit diagram of a pixel circuit 11F according to Circuit 6. In FIG. 8, similar components as in FIG. 4 are indicated with the same reference numerals. In the pixel circuit 11F, the second scanning line 15B, the third scanning line 15C, and the fourth scanning line 15D are combined together so as to drive the third transistor 23, the fourth transistor 24, and the fifth transistor 25 by a common scanning pulse SCAN2. In this case, the third and fifth transistors 23 and 25 have a conductivity type opposite to that of the fourth transistor 24. In Circuit 6, N-channel transistors are used for the third and fifth transistors 23 and 25, and a P-channel transistor is used for the fourth transistor 24.

The operations of the threshold voltage compensation, the data writing, and the data holding in the pixel circuits 11C to 11F according to Circuit 3 to Circuit 6, respectively, are basically the same as in the pixel circuit 11B of Circuit 2. Thus, the threshold voltage compensation features of the pixel circuits 11C to 11F are achieved in a similar way to the pixel circuit 11B.

Since two or all three of the second, third, and fourth scanning lines 15B, 15C, and 15D are combined together in each of the pixel circuits 11C to 11F, the reduction in the number of scanning lines allows the pixel circuit to have a smaller structure. The combining of the scanning lines also reduces the number of scanning pulses output from the scan driver 14 (see FIG. 1) and allows a reduction in the size of, for example, an output buffer of the scan driver 14. This contributes to a simplified structure of the scan driver 14.

In the pixel circuits 11A to 11F according to Circuit 1 to Circuit 6, respectively, the voltage value of the power-supply voltage VCC3 of the third power line 33 is required to be set differently from the power-supply voltage VCC1 of the first power line 31. The difference in the voltage value, however, is not specified.

[Circuit 7]

Figure 9:
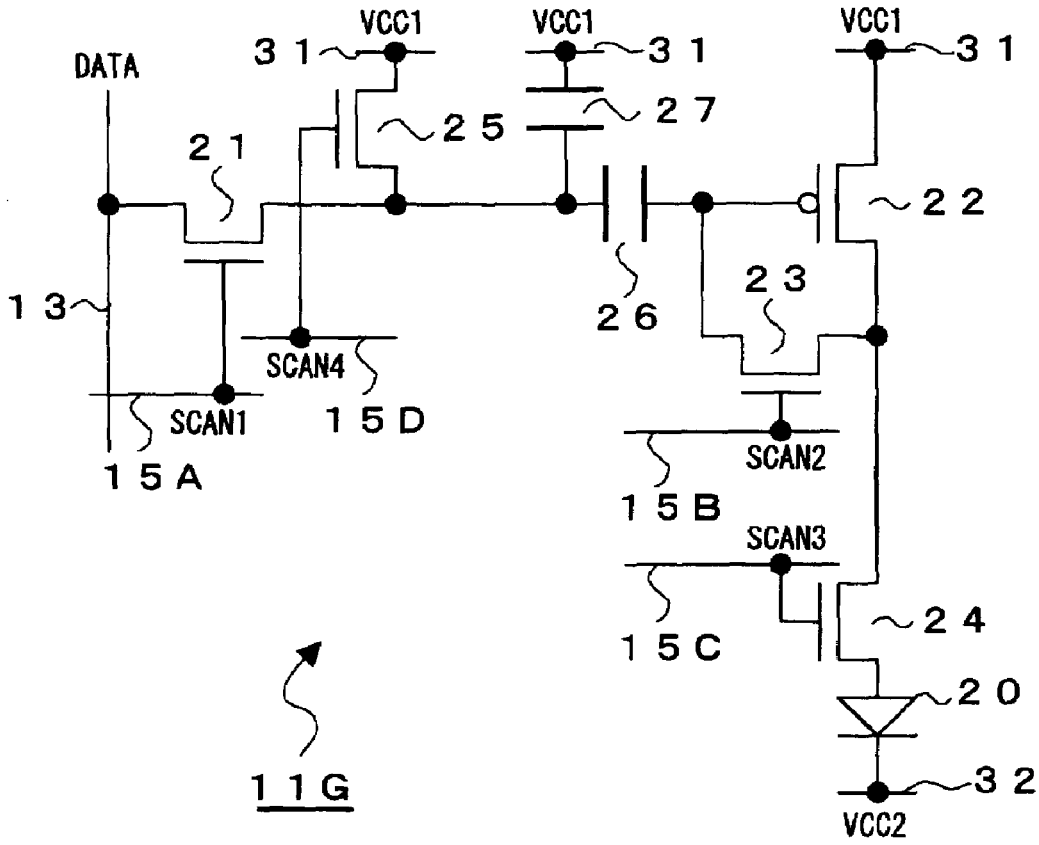
FIG. 9 is a circuit diagram of a pixel circuit of Circuit 7.

FIG. 9 is a circuit diagram of a pixel circuit 11G according to Circuit 7. In FIG. 9, similar components as in FIG. 4 are indicated with the same reference numerals. In the pixel circuit 11G, the first power line 31 and the third power line 33 are combined together so as to supply the power-supply voltage VCC1, namely the fixed voltage $V_o$, to the first capacitor 26. The remaining structure is the same as in the pixel circuit 11B of Circuit 2. Thus, the threshold voltage compensation features of the pixel circuit 11G are achieved in a way similar to the pixel circuit 11B.

By combining the first power line 31 and the third power line 33 together, the number of power lines is reduced and similar threshold voltage compensation features as in the pixel circuit 11B are achieved, whereby a pixel circuit with a smaller structure is achieved. Furthermore, the reduction of one power-supply voltage simplifies the structure of the circuit.

Although the first power line 31 and the third power line 33 are combined in the pixel circuit 11G using the basic structure of the pixel circuit 11B of Circuit 2, the pixel circuit 11G may further have the second scanning line 15B and the fourth scanning line 15D combined, as in the pixel circuit 11C of Circuit 3.

In each of the pixel circuits 11A to 11G, the source terminal of each of the first to fifth transistors 21 to 25 corresponds to a first electrode, and the drain terminal of each of the first to fifth transistors 21 to 25 corresponds to a second electrode. The conductivity types of the first to fifth transistors 21 to 25 are not limited to the circuit examples, and they may be changed to an opposite-conductivity type as desired.

Figure 10:
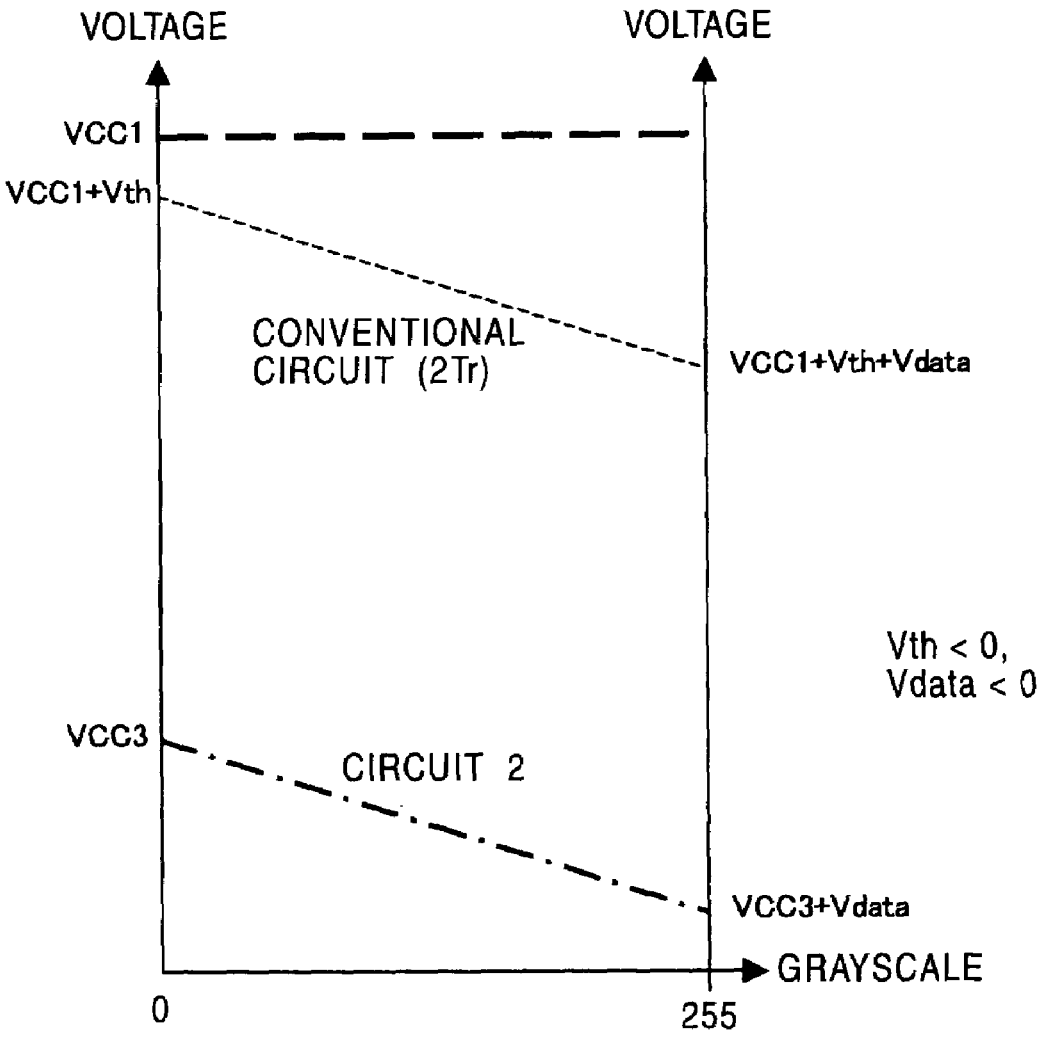
FIG. 10 illustrates the relationship between input data (grayscale) and the voltage of signal lines.
Figure 11:
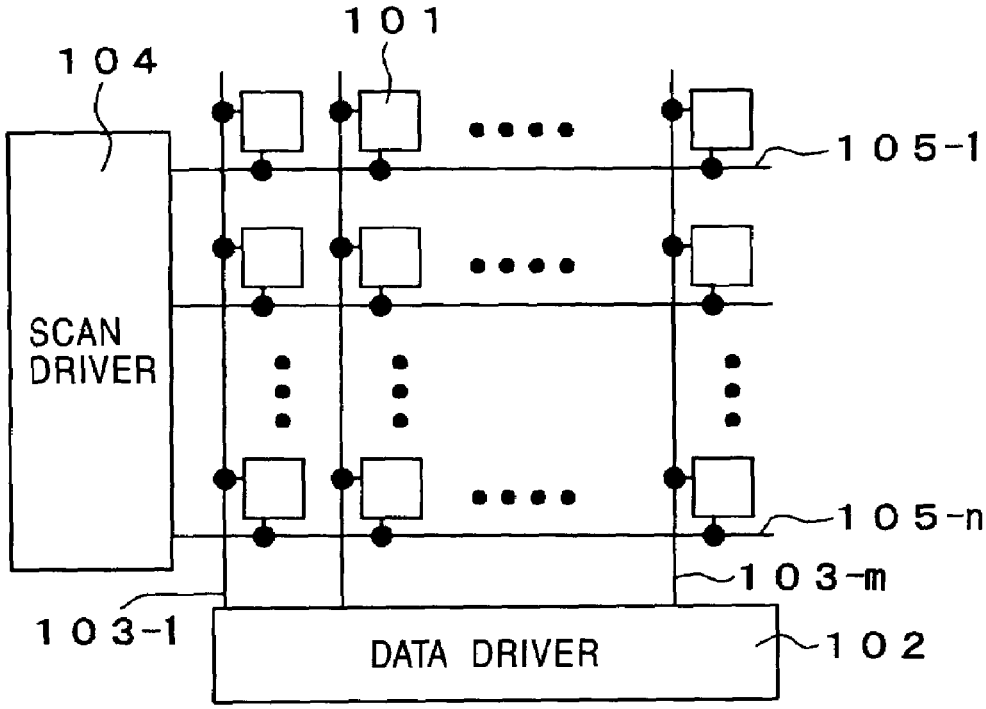
FIG. 11 is a schematic block diagram of a simple active-matrix organic-EL display.
Figure 12:
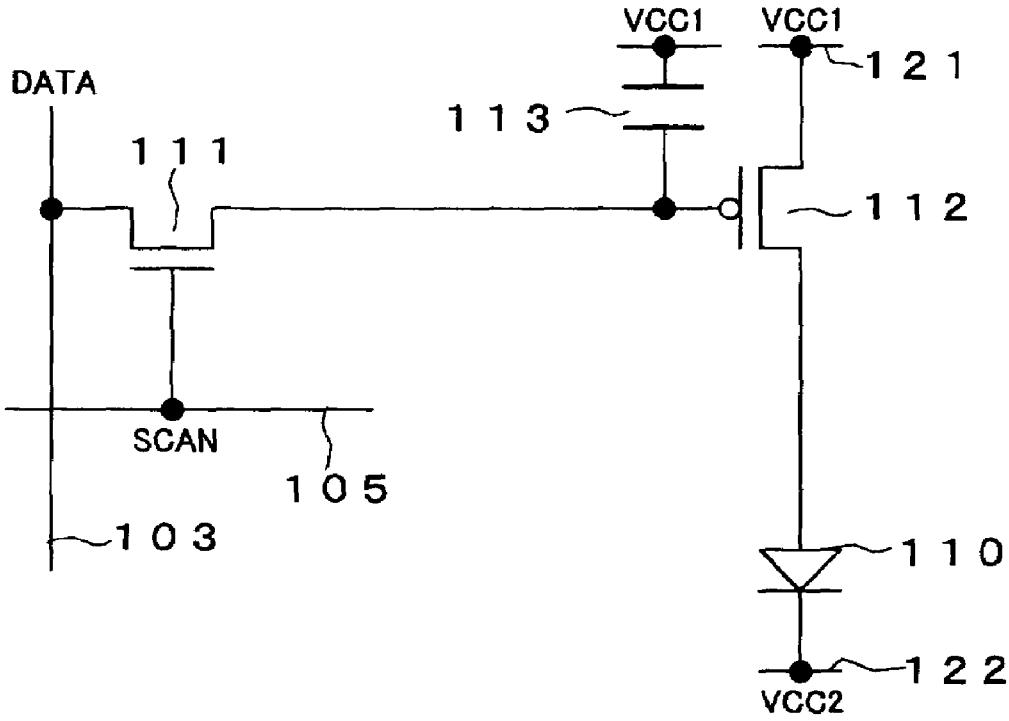
FIG. 12 is a circuit diagram of a pixel circuit having two transistors.
Figure 13:
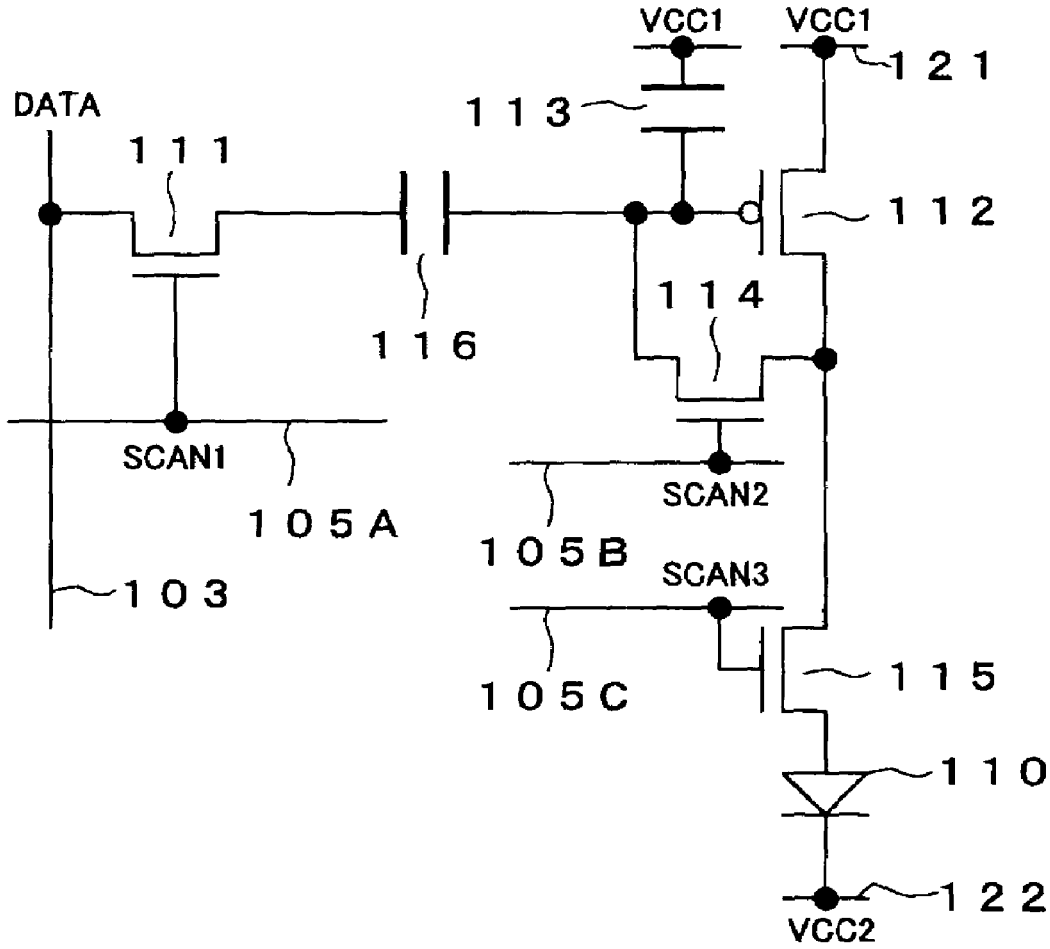
FIG. 13 is a circuit diagram of a conventional pixel circuit.
Figure 14:
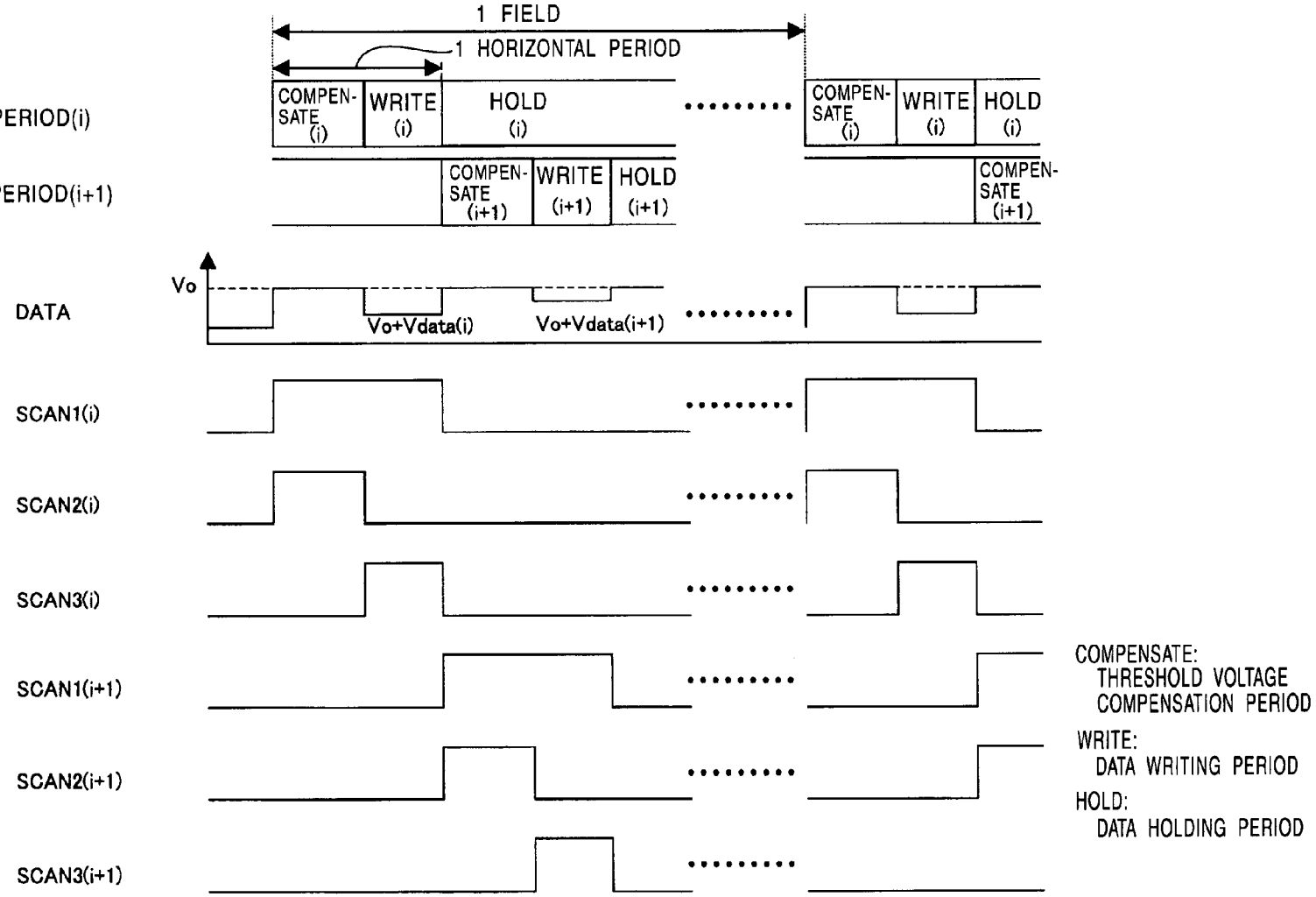
FIG. 14 is a timing diagram for describing the operation of the conventional pixel circuit.

A process for determining the voltage of the signal line 13 will now be described. FIG. 10 illustrates the relationship between input data (grayscale) and the voltage for the conventional pixel circuit in FIG. 12 having two transistors and for the pixel circuit 11B of Circuit 2 in FIG. 4. The relationship of the voltage is between the signal line 103 of the conventional pixel circuit and the signal line 13 of the pixel circuit 11B.

In the conventional pixel circuit, the voltage of the signal line 103 is affected by the power-supply voltage VCC1. For this reason, when the power-supply voltage VCC1 is large, the voltage of the signal line 103 has a tendency also to become large. On the other hand, equation (7) holds for the pixel circuit 11B of Circuit 2, and the luminance data is therefore determined by the difference with respect to the power-supply voltage VCC3. Accordingly, the power-supply voltage VCC3 can be set substantially small, independently from the power-supply voltage VCC1.

By setting the power-supply voltage VCC3 significantly small with respect to the power-supply voltage VCC1, the voltage of the data driver 12, that is, the signal line driving circuit, may be reduced so that low power consumption can be achieved. In an actual pixel circuit, high parasitic capacitance exists between the interconnections and in the transistors, and the supply of accurate luminance data is thus difficult. A variable power-supply voltage VCC3 can be used for fine adjustment for an accurate grayscale display. This can be used similarly in the pixel circuits 11C to 11F of Circuit 3 to Circuit 6, respectively.

In the above-mentioned embodiment, an organic-EL element is used as the display element of each pixel, and polysilicon thin film transistors are used as the active elements. Although the present invention was described with each example of an active-matrix organic-EL display having organic-EL elements formed on a substrate with polysilicon thin film transistors thereon, the present invention is not limited to active-matrix organic-EL displays. The present invention is thus applicable to all sorts of active-matrix display devices having a display element for every pixel and being capable of holding the luminance data in each pixel.

What is claimed is:

1. An active-matrix display device comprising:

pixel circuits arrayed in a matrix;

signal lines each of which is interconnected with a corresponding column of the matrix-arrayed pixel circuits; and a first scanning line, a second scanning line, a third scanning line, and a fourth scanning line that are interconnected with a corresponding row of the matrix-arrayed pixel circuits;

each of the pixel circuits comprising:

a first transistor of which a gate terminal is connected with the first scanning line and of which a first electrode terminal is connected with one of the signal lines;

a first capacitor of which a first end is connected with a second electrode terminal of the first transistor;

a second capacitor of which a first terminal is connected with the first end or a second end of the first capacitor;

a second transistor of which a gate terminal is connected with the second end of the first capacitor and of which a first electrode terminal is connected with a first power line;

a third transistor of which a gate terminal is connected with the second scanning line, a first electrode terminal of the third transistor is connected with the gate terminal of the second transistor, and a second electrode terminal of the third transistor is connected with a second electrode terminal of the second transistor;

a fourth transistor of which a gate terminal is connected with the third scanning line and of which a first electrode terminal is connected with the second electrode terminal of the second transistor;

a fifth transistor of which a gate terminal is connected with the fourth scanning line, a first electrode terminal of the fifth transistor is connected with a third power line, and a second electrode terminal of the fifth transistor is connected with the second electrode terminal of the first transistor; and a display element connected with both a second electrode terminal of the fourth transistor and a second power line.

2. The active-matrix display device according to claim 1, wherein the third transistor and the fifth transistor have the same conductivity type, and the second scanning line and the fourth scanning line are combined as a common line.

3. The active-matrix display device according to claim 1, wherein the third transistor and the fourth transistor have opposite conductivity types, and the second scanning line and the third scanning line are combined as a common line.

4. The active-matrix display device according to claim 1, wherein the fourth transistor and the fifth transistor have opposite conductivity types, and the third scanning line and the fourth scanning line are combined as a common line.

5. The active-matrix display device according to claim 1, wherein the third transistor and the fifth transistor have a conductivity type opposite to that of the fourth transistor; and the second scanning line, the third scanning line, and the fourth scanning line are combined as a common line.

6. The active-matrix display device according to claim 1, wherein the first power line and the third power line are combined as a common line.

7. The active-matrix display device according to claim 1, wherein a power-supply voltage of the third power line is lower than that of the first power line.

8. The active-matrix display device according to claim 7, wherein the power-supply voltage of the third power line is variable.

9. The active-matrix display device according to claim 1, wherein the first to fifth transistors are polysilicon thin film transistors.

10. The active-matrix display device according to claim 1, wherein the display element is an organic electroluminescent element which includes an organic layer having a luminous layer disposed between a first electrode and a second electrode.

11. A method for driving an active-matrix display device, the device comprising: pixel circuits arrayed in a matrix; signal lines each of which is interconnected with a corresponding column of the matrix-arrayed pixel circuits; and a first scanning line, a second scanning line, a third scanning line, and a fourth scanning line that are interconnected with a corresponding row of the matrix-arrayed pixel circuits;

each of the pixel circuits comprising:

a first transistor of which a gate terminal is connected with the first scanning line and of which a first electrode terminal is connected with one of the signal lines; a first capacitor of which a first end is connected with a second electrode terminal of the first transistor; a second capacitor of which a first terminal is connected with the first end or a second end of the first capacitor; a second transistor of which a gate terminal is connected with the second end of the first capacitor and of which a first electrode terminal is connected with a first power line; a third transistor of which a gate terminal is connected with the second scanning line, a first electrode terminal of the third transistor is connected with the gate terminal of the second transistor, and a second electrode terminal of the third transistor is connected with a second electrode terminal of the second transistor; a fourth transistor of which a gate terminal is connected with the third scanning line and of which a first electrode terminal is connected with the second electrode terminal of the second transistor; a fifth transistor of which a gate terminal is connected with the fourth scanning line, a first electrode terminal of the fifth transistor is connected with a third power line, and a second electrode terminal of the fifth transistor is connected with the second electrode terminal of the first transistor; and a display element connected between a second electrode terminal of the fourth transistor and a second power line; the method comprising the steps of:

turning the first transistor and the fourth transistor off while turning the third transistor and the fifth transistor on to compensate for a threshold voltage of the second transistor in each pixel; and turning the first transistor on while turning the third transistor and the fifth transistor off to write display data into each pixel from the signal line.

12. The method for driving an active-matrix display device according to claim 11, wherein a period for compensating the threshold voltage and a period for writing the display data reside simultaneously in pixels that are in different rows and are connected along the same signal line.

* * * * *